United States Patent [19]

Baldini

[11] 4,008,671

[45] Feb. 22, 1977

[54] TROLLEY WITH FOLDING SHELVES

[75] Inventor: Giovanni Baldini, Turin, Italy

[73] Assignee: Carrar & Matta S.p.A., Turin, Italy

[22] Filed: Jan. 20, 1976

[21] Appl. No.: 650,646

[30] Foreign Application Priority Data

Feb. 7, 1975 Italy .....67331/75

[52] U.S. Cl. ..... 108/113

[51] Int. Cl.[2] ..... A47B 3/00

[58] Field of Search ..... 108/99, 100, 112, 113; 297/43, 323, 331

[56] References Cited

UNITED STATES PATENTS

| | | | |
|---|---|---|---|
| 489,328 | 1/1893 | Rieckert | 297/43 |
| 2,938,632 | 5/1960 | Mondineu | 108/116 X |

*Primary Examiner*—James C. Mitchell

*Attorney, Agent, or Firm*—Sughrue, Rothwell, Mion, Zinn & Macpeak

[57] ABSTRACT

A trolley with folding shelves comprising two uprights mounted on feet having castors enabling the trolley to be moved about easily, in which the shelves are each formed as a pair of half-shelves pivotable about the edge adjacent the other half-shelf of the pair, and the feet each comprise two arms which are pivotable about a vertical axis between a first position extending perpendicular to the plane defined by the two uprights and a second position extending parallel to this plane. The uprights house a connecting mechanism between the half-shelves and the arms so that when the half shelves are moved about their axes from a horizontal to a vertical position the arms are moved by the connecting mechanism from their first to their second position.

7 Claims, 4 Drawing Figures

TROLLEY WITH FOLDING SHELVES

The present invention relates to a trolley with folding shelves, and particularly to a trolley with several shelves which may be easily folded thereby reducing the trolley to a very flat form for storage, packing or simply so that it uses very little space when not in use. Trolleys formed as embodiments of the present invention can be so constructed that they are completely devoid of visible mechanical members, thereby providing a pleasing aesthetic appearance.

According to the present invention there is provided a trolley of the type having folding shelves, comprising a pair of hollow uprights rigidly connected together, at least two shelves extending between the uprights, each shelf being constituted by a pair of half-shelves each of which is pivoted to the uprights in such a way as to be able to turn about an axis substantially coincident with the edge thereof adjacent the other half-shelf, between a first position in which it is substantially perpendicular to the uprights and a second position, in which it is substantially parallel to the plane defined by the two uprights, two support feet, one for each of the uprights, each foot being formed by two arms each carrying a castor and each being pivoted to the associated upright for movement about an axis parallel to the said associated upright between a first position in which the arm extends perpendicular to the plane defined by the two uprights, and a second position in which the arm extends parallel to the plane defined by the two uprights, and a connecting mechanism between each half-shelf and the said arms, the connecting mechanism being accommodated inside the uprights and being such that, when the half-shelves are caused to turn from the first position to the second position, the arms are caused by the connecting mechanism to turn from their first position to their second position.

Trolleys formed as embodiments of this invention have the advantage that they can be produced entirely in plastics materials, including all of the mechanical members.

One embodiment of the invention will now be more particularly described, by way of example, with reference to the accompanying drawings, in which.

Figure 1:
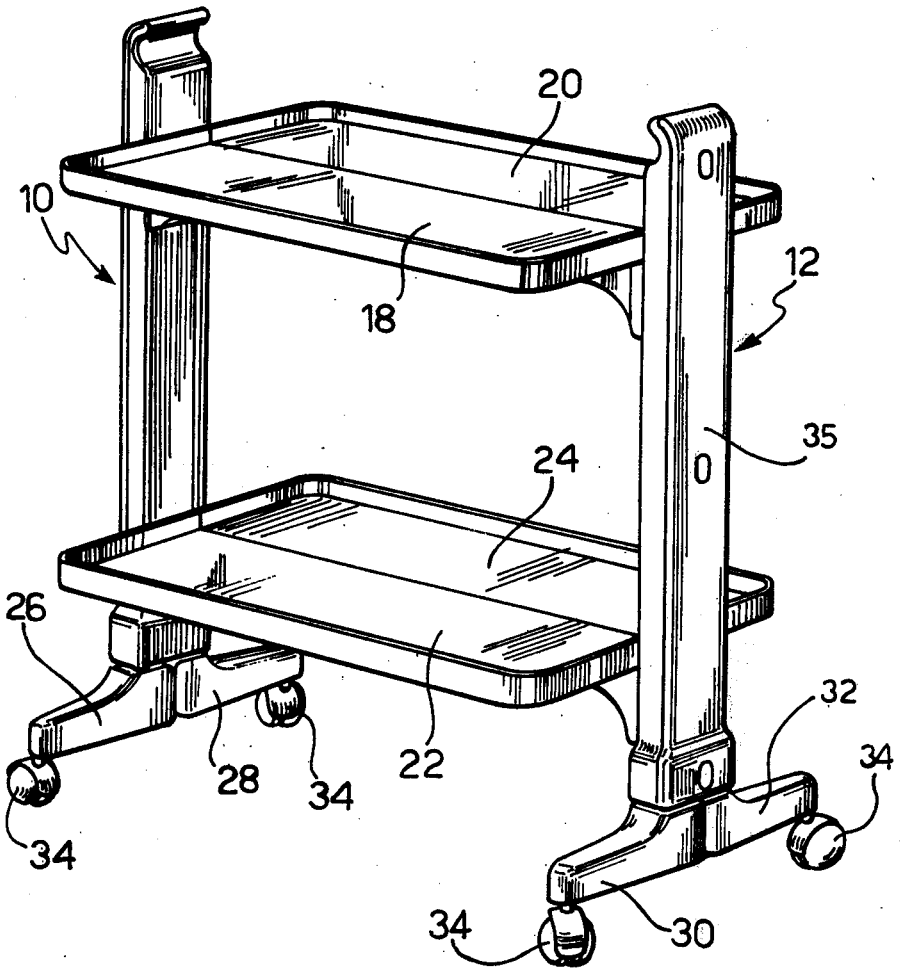
FIG. 1 is a perspective view of a trolley formed as an embodiment of the invention, shown in a completely unfolded state.
Figure 2:
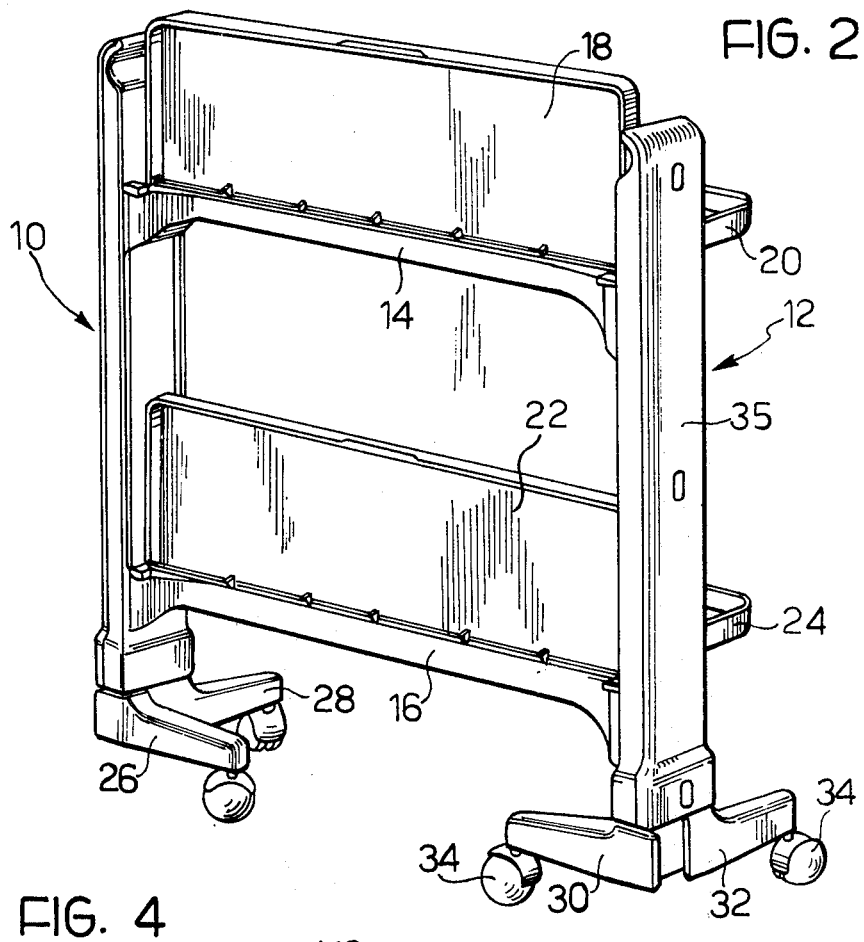
FIG. 2 is a perspective view similar to FIG. 1, but with the trolley in a partially folded state.

Referring now to FIGS. 1 and 2, the embodiment shown comprises a pair of uprights 10 and 12 connected rigidly together by a pair of horizontal longitudinal members 14 and 16 (FIG. 2). For the purpose of this specification it will be assumed that the trolley is standing upright on a level horizontal floor, and references to "horizontal" and "vertical" members will be construed only with the trolley in this orientation.

In the embodiment illustrated, there are two half-shelves 18 and 20 located immediately above the upper longitudinal member 14, and two half-shelves 22 and 24 immediately above the lower longitudinal member 16. The two half-shelves of each pair are arranged such that they can each turn about respective horizontal axes joining the two uprights, which axes are each substantially coincident with the longitudinal edge of each half-shelf adjacent the other half-shelf of the pair; the half-shelves are turnable from a horizontal first or working position upwardly to a substantially vertical second or storage position and back down to the first, horizontal, position as required. When both half-shelves of a pair are down in the first position, they form, together, a tray-like shelf which projects laterally in both directions from the upright plane defined by the two uprights 10, 12. The half-shelves 18, 20, 22 and 24 are shown in the first position in FIG. 1. In FIG. 2 the half-shelves 18 and 22 situated on one side of the longitudinal plane of the trolley defined by the two uprights are shown tilted up to the second position.

The two longitudinal members 14 and 16 and the respective half shelves are so shaped that they interengage with one another when the half-shelves are in the first position, preventing the half-shelves from falling below the horizontal position.

The uprights 10 and 12 are carried by support feet each of which includes a pair of arms pivoted to the uprights 10, 12 for movement about vertical axes parallel to and coincident with the uprights 10, 12 themselves. Thus, the upright 10 is supported by a pair of arms 26 and 28, and the upright 12 is supported by a pair of arms 30 and 32. Adjacent their free ends, the four arms 26, 28, 30 and 32 are provided with castors 34, of known type, which permit the trolley to be moved about readily.

Each of the arms 26, 28, 30, 32 is able to rotate about its pivot axis from a first or working position, in which it extends perpendicularly out from the longitudinal plane of the trolley defined by the two uprights, to a second, or storage position, in which it lies substantially parallel to this plane and extends towards the upright of the trolley opposite that to which it is pivoted. As shown, in FIG. 1 all the arms 26, 28, 30, 32 are in the first position, whilst in FIG. 2 the arms 28 and 32 are still in the first position and the arms 26 and 30 are in the second position.

All the components so far described can readily be manufactured in plastics material. The uprights 10 and 12, the longitudinal members 14 and 16 as well as the arms 26, 28, 30 and 32 may be produced, for example, in ABS, whilst the half shelves 18, 20, 22, 24 may be made of a melamine resin, or any other plastics material which is highly resistant to heat and to chemical agents.

Each longitudinal member 14, 16 may comprise an extended component having an inverted channel-section, containing a tie rod which rigidly interconnects the uprights 10 and 12. The longitudinal members 14, 16, as well as acting as supports for the half-shelves in their horizontal or first position, also act as spacers between the uprights.

Between the half-shelves 18, 20, 22, 24 and the arms 26, 28, 32, 34, there is an operating mechanism which, when the half-shelves are caused to turn between their first and second positions, transmits the movement to the arms also so that these are made to turn from their first to their second positions.

The connecting mechanism is such that when the upper half shelf 18 is caused to rotate, for example, by hand, from the first to the second position, this movement is also transferred to the half shelf 22 which is located on the same side of the longitudinal plane defined by the uprights of the trolley, and at the same time the arms 26 and 30 which are on that side also rotate between the first position and the second position. Likewise, a mechanism interlinks the half-shelves 20 and 24 and arms 28 and 32 on the other side of the trolley so that displacement movement applied to one of the two shelves is transferred to the other half-shelf and to the two arms moving them to their first or second positions to correspond to the movements applied to one of the half-shelves. The uprights 10 and 12 are hollow, and the operating mechanisms are completely contained inside them. The internal cavities of the uprights 10 and 12 are closed by a removable wall 35.

Figure 4:
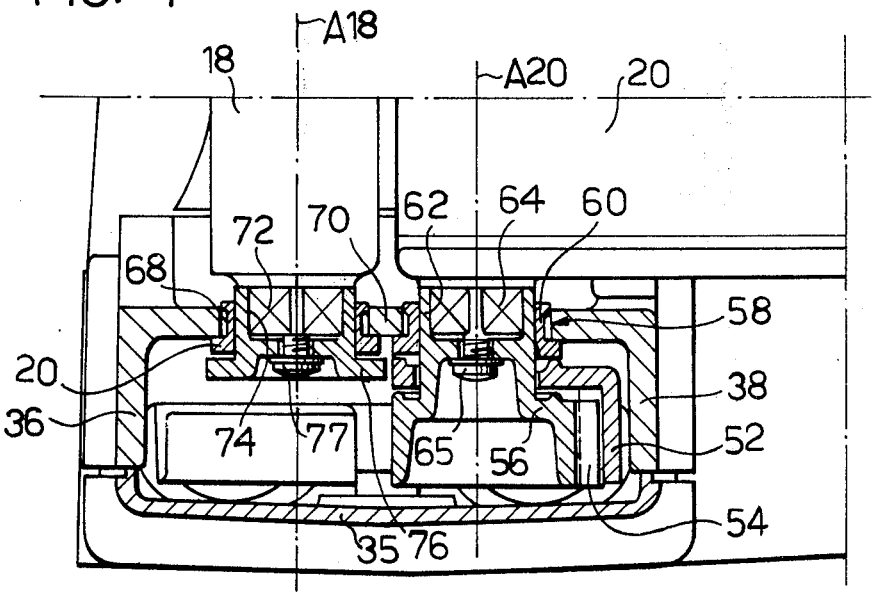
FIG. 4 is a section taken on the line IV—IV of FIG. 3.
Figure 3:
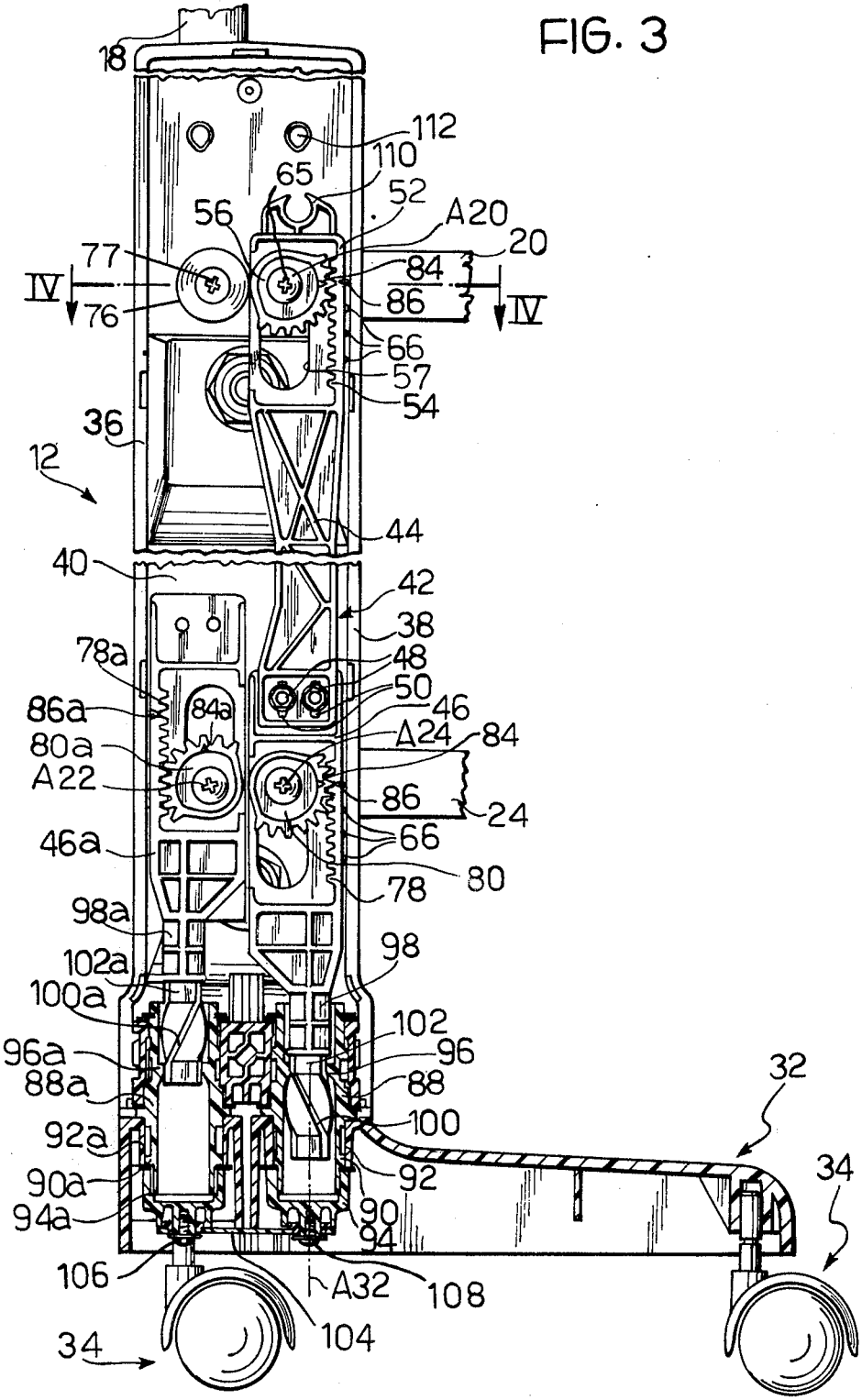
FIG. 3 is a partially sectioned internal view of one of the trolley uprights, showing the mechanism contained in the upright.

FIG. 3 and FIG. 4 both illustrate a preferred embodiment of the connecting mechanism. The two uprights 10 and 12 are identical, and the mechanisms contained within these are also identical, so that only the arrangement relative to one upright will be described in detail. In FIG. 3 the upright 12 has been shown with its removable wall 35 removed, this wall, however, being indicated in section in FIG. 4. Without the wall 35 the upright 12 has substantially the form of a channel with two side walls 36, 38 and a base wall 40, which latter is on the side of the upright 12 nearest the other upright 10.

Within the upright 12 is mounted, for vertical sliding movement, a transmission bar 42 which, in order to enable its longitudinal adjustment, is in two parts 44 and 46 interconnected at an intermediate point by a nut and bolt system 48, in which the bolts pass through slots 50, in one of the two parts of the bar 42.

The upper part 44 of the bar 42, at the height of the pivot axis (indicated $A_{20}$) of shelf 20, has an elongate opening 57 extending parallel to the wall 38 of the channel. The opening 57 has an enlarged recess 52 adjacent one face of the bar. On one internal face of the enlarged recess 52 there is formed a rack 54 which engages with a toothed sector 56 carried within a bush 60 in a hole 58 in the base wall 40 of the channel. The toothed sector 56 has a prismatic recess in the form of a squared seating 62 in which is fixed a corresponding squared projection 64 of the half-shelf 20, by which toothed sector 56 and the half shelf 20 are fixed rigidly together and the half shelf 20 is pivoted to the upright 12 about the axis $A_{20}$. The fixing of the toothed sector 56 to the half shelf 20 is secured by a screw 65. Any rotation imparted to the half-shelf 20 will therefore give rise to a vertical displacement, up or down, of the bar 42. On the outside of the bar 42, adjacent the rack 54, there are a plurality of small projections 66 which slide in contact with the wall 38 of the upright channel. The teeth of the toothed sector 56 extend over an arc slightly greater than 90° so that it can engage the rack as the half-shelf 20 is turned through substantially 90°.

At the same height as the pivot axis $A_{20}$ and on the other side of the trolley, the half-shelf 18 is pivoted to upright 12 in a hole 62 similar to hole 58 to define a pivot axis $A_{18}$.The half-shelf 18 has a prismatic projection 72 of the same form as the prismatic projection 64 and engaged in a prismatic recess 74 of a support member 76 similar to the toothed sector 56, but devoid of teeth; the member 76 is housed in a bush 70 in the hole 62. Here also the member 76 is secured to the half-shelf 18 by means of a screw 77.

On the other upright 10 there is a corresponding mechanism, that is to say that on axis $A_{20}$ of the half-shelf 20 there is a pivot system without a toothed sector, whilst on the axis $A_{18}$, secured to the half-shelf 18, there is a toothed sector like toothed sector 56 and engaged with a rack on a transmission bar like the bar 42.

Correspondingly, associated with the pivot axis $A_{24}$ of the half-shelf 24 there is a rack and pinion coupling system substantially identical to that described above for the axis $A_{20}$ of the half-shelf 20.

The lower section 46 of the bar 44 has a rack 78 in engagement with a toothed sector 80 which is identical to the toothed sector 56. The toothed sector 80 is secured to the half-shelf 24 and passes through the upright 12 to serve as a pivot for the half-shelf 24. In this region also the transmission bar 46 is provided with projections 66 to guide it along the wall 38. The toothed sectors and their associated racks thus form rack and pinion couplings 56-54 and 80-78 so that, with correct adjustment, effected by means of the connection 48 between the two parts 44 and 46 of the bar 42, the two half-shelves 20, 24 on one side of the trolley are linked for simultaneous movement, which movement may be imparted to either of the half-shelves and will be transmitted to the other by the transmission bar 42 and its rack and pinion couplings. To facilitate initial adjustment upon assembly, appropriate reference indicia 84, 86 are provided on the toothed sectors 56, 80 and on the racks 54, 78 respectively.

Arm 32, bearing its castor 34, is pivoted to the lower end of the upright 12 around a vertical axis $A_{32}$, by means of a tubular pin 88 having two prismatic parts one of which is engaged in a corresponding prismatic seating 92 of arm 32. The tubular pin 88 is rigidly secured to the arm 32 by means of a nut 94 of cap form, screwed onto a projecting lower end of the pin 88.

The tubular pin 88 has an internal bulkhead 96 in which is machined an opening of square section able to act as a female nut.

The lower part 46 of the transmission bar 42 has at its lower end a spigot 98 which penetrates into the tubular pin 88 and terminates in a helicoidal stub shaft 100, having a long pitch and a square cross section which cooperates with the square-section opening in the bulkhead 96. It will be apparent that axial movement of the transmission bar 42 thus produces rotation of the arm 32, due to the coupling between the stub shaft 100 and the square opening in the interior of the tubular pivot pin 88. The direction and pitch of the helical square-section stub shaft in relation to the traverse of the bar 42 are so chosen that when the half-shelves 20 and 24 are lowered to their horizontal or first position the arm 32 is found in its extended or first position, directed perpendicularly to the plane defined by the two uprights 10, 12 of the trolley. Correspondingly, when the half-shelves 20 and 24 are raised to their second or vertical positions, the arm 32 is moved to its second position parallel to the plane defined by the two uprights 10, 12.

In FIG. 3, the arm 32 has been shown in its first position, with the transmission bar 42 in the lower stop position. In order to maintain the arm 32 in the first position without play, the helicoidal part 100 of the spigot 98 terminates at its upper end in a prismatic (square) section 102, which is slightly tapered towards its base and is such as to wedge into the bulkhead opening 96 to produce a firm locking. The arm 32 is illustrated in this condition in FIG. 3.

The rotation of arm 32 about its vertical axis is accompanied by a corresponding and simultaneous movement of the arm 28 of the upright 10, which arm is on the same side of the trolley as the arm 32. The transmission of movement to the arm 28 is effected through the half-shelf 24, which acts as a transmission shaft having axis $A_{24}$, and which is pivoted on upright 10 by means of a toothed sector arrangement, similar to that of the toothed sector 80, in engagement with the rack of a lower transmission bar similar to the part 46*a* i.e., having no corresponding upper section.

A similar arrangement for the half-shelves 18 and 22 linking them to arms 26 and 30, is positioned on the other side of the trolley. As can be seen in FIG. 3, a transmission bar 46*a* corresponding to the lower part 46 of the transmission bar 42, links a pivot mechanism 90*a*, 92*a*, 94*a* for the arm 30 with a rack and pinion arrangement for the shelf 22. The transmission bar 46*a* serves to produce the rotation of the arm 30 from the movement of the half-shelf 22, which movement is derived from the mechanism located in the upright 10.

Since the operating system for arm 30 is substantially identical to that for operating the arm 32, it will not be described in detail. The main components have been indicated by the same reference numerals followed by the suffix *a*.

It will be mentioned only that the transmission bar 46*a* has been shown in the upper stop position, in which the arm 30 is in the storage or second position.

In order to provide utmost stability to the pair of support arms, as shown in FIG. 3, the retainer nuts 94 and 94*a* which hold the tubular pins 88, 88*a* in place, are rigidly interconnected by means of a small plate 104 fixed to these nuts by means of screws 106 and 108.

Toothed sectors 80, 80*a* are used rather than complete pinions since, due to their proximity to one another, these would interfere if they had teeth all around. The toothed sector 56 is used rather than a pinion simply so as not to multiply the type of pieces used in the mechanism of the trolley.

Both the movable and the fixed structural parts of the trolley, as well as the many mechanical parts, such as the toothed sectors, the transmission bar parts, the bushes, the hollow pins and such, may all be conveniently produced in plastics material, for example in an acetal resin.

It will also be noted that, whilst when the half-shelves are in the first or horizontal position they are firmly held there by gravity, this will not be the case when the half-shelves are in the second, or storage, position. There is therefore provided an arrangement for holding the half-shelves in the storage position when they are moved thereto, in order to combat the effect of gravity. This arrangement comprises a projection 110 on the top of the upper part 44 of the transmission bar 42, which has a pincer-like shape. A cooperating boss 112 is positioned on the upright 12 at such a height that when the half-shelves 20 and 24 are turned to their storage position, and the transmission bar 42 is raised to its highest position the pincer-like projection 110 on the upper part 44 of the transmission bar 42 can snap engage over the boss 112 to hold the mechanism in that position against the action of gravity. The force of the snap-engaged parts can easily be overcome by hand, however, when it is desired to move the half-shelves down again to their first or working position. There is a completely identical system in the other upright 10. However, for the same purpose, it would be possible to use a snap engagement system of any other type and situated in any other suitable position.

Various modifications to the invention described above are possible. For example, although a trolley has been described and illustrated comprising only two shelves, it would be possible to produce trolleys having any desired number of shelves, each formed by a pair of half-shelves as described above.

What is claimed is:

1. A trolley of the type having folding shelves, comprising:

a. a pair of hollow uprights;

b. means rigidly interconnecting said hollow uprights;

c. at least two shelves extending between said two uprights, each of said shelves being constituted by a pair of half-shelves;

d. pivot means for pivoting each half-shelf of a pair to said uprights, independently of the other half-shelf of the pair, for turning movement about an axis substantially coincident with that edge of the half-shelf adjacent the other half-shelf of the pair between a first position of said half-shelf in which the plane of said half-shelf is substantially perpendicular to the plane defined by said two uprights and a second position in which the plane of said half-shelf is substantially parallel to said plane defined by said two uprights;

e. two support feet located at the lower end of respective uprights, each of said feet being constituted by a pair of arms;

f. means for pivotally connecting each arm of a pair of said arms to said uprights, independently of the other arm of the pair, for movement about respective axes substantially parallel to the associated upright between a first position of each said arm in which it extends substantially perpendicular to said plane defined by said two uprights and a second position of each said arm in which it extends substantially parallel to said plane defined by said uprights; and g. a connecting mechanism interconnecting all of said half-shelves and said arms on each side of the trolley, said connecting mechanisms being housed in said hollow uprights and operating to transmit movement from any one of said half-shelves on each side of the trolley to said arms on the same side of the trolley, whereby, when any one of said half-shelves is moved from its first position to its second position, said arms are caused by said connecting mechanism to turn from their first to their second positions, and correspondingly, when any one of said half-shelves is moved from its second to its first position, said arms are caused by said connecting mechanism to turn from the second to their first positions.

2. The trolley of claim 1, wherein said uprights, said half-shelves, said support feet, and said connecting mechanisms are all formed of plastics material.

3. The trolley of claim 1, wherein each said half-shelf is provided at least at one of its ends with a pinion coaxial with the pivot axis of the half-shelf and having gear teeth over at least a part of the circumferential periphery thereof, said connecting mechanism being formed in two parts, one part interconnecting said half-shelves and said arms on one side of said plane defined by said uprights of said trolley and the other part interconnecting said half-shelves and said arms on the other side of said plane defined by said uprights, each of said two parts of said connecting mechanism comprising:

a. a first upright transmission bar inside one of said uprights, said first transmission bar being provided, adjacent each half-shelf, with a rack meshing with an associated one of said pinions;

b. a male helicoidal member at the lower end of said first transmission bar, said male helicoidal member being engaged with a cooperating female member carried by the associated one of said arms and coaxial with its pivot axis;

c. a second upright transmission bar inside the other of said uprights, said second transmission bar being provided, adjacent the lower one of said half-shelves, with a rack meshing with said pinion of said adjacent lower half-shelf; and d. a further male helicoidal member at the lower end of said second upright transmission bar, said further male helicoidal member being engaged with a corresponding female member carried by the associated one of said arms coaxial with its pivot axis.

4. The trolley of claim 3, wherein said female member carried by each one of said arms is formed by a polygonal opening in an internal bulkhead of a hollow pivot pin carried by the respective one of said arms.

5. The trolley of claim 4, wherein said first and second transmission bars each have a slightly tapered prismatic part, which part is inserted into the associated one of said polygonal openings when the respective arm is moved to the first position thereof.

6. The trolley of claim 3, wherein each of said first transmission bars comprises two or more transmission bar parts connected together end to end by connecting means which permit the overall length of said transmission bar to be adjusted.

7. The trolley of claim 3, wherein each one of said transmission bars is provided with snap engagement elements for engagement with cooperating elements on the associated one of said uprights when the associated half-shelves and the associated arms are moved to their second position.

* * * * *